US006746259B2

(12) United States Patent
Arai

(10) Patent No.: US 6,746,259 B2
(45) Date of Patent: Jun. 8, 2004

(54) CRT SOCKET

(75) Inventor: Atu Arai, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/303,042

(22) Filed: Nov. 22, 2002

(65) Prior Publication Data

US 2003/0109154 A1 Jun. 12, 2003

(30) Foreign Application Priority Data

Dec. 6, 2001 (JP) ..... 2001-372082

(51) Int. Cl.[7] ..... H01R 13/53
(52) U.S. Cl. ..... 439/182; 439/683
(58) Field of Search ..... 439/182, 682, 439/683, 684; 313/325

(56) References Cited

U.S. PATENT DOCUMENTS 3,683,228 A * 8/1972 Kleen ..... 439/683
4,400,645 A * 8/1983 Simovits, Jr. et al. ..... 313/325
4,960,385 A * 10/1990 Kim ..... 439/182
6,019,642 A * 2/2000 Nagata ..... 439/683
6,570,331 B2 * 5/2003 Arakawa et al. ..... 439/182
2001/0018297 A1 8/2001 Arai

FOREIGN PATENT DOCUMENTS

JP 2001 015238 1/2001
JP 2003 100404 4/2003

* cited by examiner

*Primary Examiner*—Khiem Nguyen
(74) *Attorney, Agent, or Firm*—Cohen, Pontani, Lieberman & Pavane

(57) ABSTRACT

The invention aims to provide an effectively miniaturized CRT socket capable of assuring large withstanding discharge voltage difference between the focus pins of the CRT socket, unifying the voltage just before discharge, and simplifying the structure of the high voltage discharge gap. A CRT (cathode ray tube) socket to which a plurality of focus means of the CRT are connected, characterized in comprising electrodes (FA) each positioned on each focus contact of a plurality of focus pins connected to the CRT respectively; a common electrode (A) which is separated from the electrodes (FA) with a low voltage discharge gap (L); and a grounded electrode (B) which is opposite to the common electrode (A) with a high voltage discharge gap (H).

1 Claim, 8 Drawing Sheets

(A)

(B)

CRT SOCKET

FIELD OF THE INVENTION

The invention relates to a CRT (cathode ray tube) socket for connecting with CRT of color TV or display, where the structure of the CRT socket is simplified and miniaturized.

RELATED PRIOR ART

In the CRT of color TV or display, along with increase in size and precision, dual-focus tube having plural of focus means is widely used so as to correspond to the high voltage of the focus voltage and to make CRT a larger viewing-angle and more miniaturized. In order to obtain high resolution image on whole area of the screen, the voltage difference applied between a plurality of focus pins is increased and a high frequency dynamic voltage waveform is repeatedly applied to the focus pins.

In the CRT socket for using in multiple-focus tube, in order to prevent abnormal discharge energy generated in the CRT from damaging circuit elements, each discharge gap is generally built in each focus portion.

Hereinafter using an example for explanation the general structure of the CRT socket for using in dual-focus tube.

FIG. 8 is a perspective view of the CRT socket 100 of the prior art, FIG. 7 is a sectional view of the main portion of the CRT socket 100, and FIG. 6 shows the structure of the main, viewing from inside of the outer case.

The CRT socket 100 comprises an annular portion 102, an outer case 103, a base portion 104, and a cylindrical center opening 105. The annular portion 102 is formed by concentrically positioning a plurality of signal contact openings 106 on the outside of the cylindrical center opening 105 formed by resin injected molded, positioning signal contact housings 161 inside the annular portion 102, positioning signal contacts 162 formed of conductive metallic plate in the signal contact housings 161, and arranging a small predetermined discharge gap to separate from a grounded metal 164, which, after being applied with abnormal voltage, will discharge to outside.

The outer case 103 comprises the focus contact openings 107*a* and 107*b* for connecting focus pins inserted to apply high voltage, and the base portion 104 covered by resin.

In the concentric position of the annular portion 102, the focus contact housings 117*a* and 117*b* are concavely positioned in the inside of the outer case, and focus contacts 170*a* and 170*b* are provided therein. Also provided therein are grounded terminals b11 and b21 of grounded electrodes b1, b2, which are provided with predetermined high voltage discharge gaps H1 and H2.

Focus contact openings 107*a* and 107*b* are positioned on the surface corresponding to the focus contact housings.

As shown in FIG. 7, terminal pins 22*a*, 22*b* to which 5–10 KV high voltage is applied for focus in CRT 20 are connected to the focus contact 170*a*, 170*b*, and a terminal pin 23 to which a plurality of signals with 0–100V low voltage are applied is connected to the signal contact 162.

The grounded terminals b11, b21 and the connecting terminal 163 for the signal contact are connected to a circuit board 21 by solder welding.

As shown in FIG. 6, i.e., the structure of focus portion viewing from inner side of the outer case, in case of having a plurality of focus portions, in the prior art, the focus contacts 170*a*, 170*b* for connecting to each terminal pin are provided with high voltage discharge electrodes a1, a2, and are respectively provided with the grounded electrodes b1, b2 opposite thereto and the grounded terminal b11, b21.

Because the high voltage discharge electrodes a1, a2 and the grounded electrodes b1, b2 are necessary for each focus terminal to form high voltage discharge gaps H1, H2, the structure of CRT socket becomes large and the elements used therein are also increased.

Due to the above problems, the applicant of the invention has disclosed a structure of CRT socket as shown in FIG. 5 (Japanese patent application 2001-285531).

For connecting to a first focus pin 22*a* on one side of the CRT, a first focus contact 70*a* is provided where one of its ends is opposite to a first focus contact opening 7*a*, and the other end is provided with a wiring contact 71*a*.

A low voltage discharge electrode A1 is pressed connected to another end of the electrode A of a second focus contact 70*b*, a low voltage discharge electrode FA is position on the first focus contact 70*a*, and a low voltage discharge gap L1 is formed therebetween.

For connecting to a second focus pin 22*b* on the other side of CRT, a second focus contact 70*b* is provided where one of its ends is opposite to the second focus contact opening 7*b*. The other end of the second focus contact 70*b* has a wiring connect portion 71*b*, and is pressed connected to a connect portion 72*b* of the second focus contact and a connect portion AW of the focus contact of the electrode A.

The electrode A is opposite to grounded electrode B with a predetermined high voltage discharge gap H intervened therebetween, and the grounded electrode B is connected to the grounded terminal B1.

Here the high voltage discharge gap H is determined along with the abnormal discharge energy. Usually, there are 5–10 KV high voltage applied to the terminal pin for focus, and thus what is defined shall be higher more than 3–5 KV.

The low voltage discharge gap L1, in consideration of the voltage difference or dynamic voltage variation of two terminal pins or focus, is usually set as 2–3 KV.

In the prior art, as shown in FIG. 6, when an abnormal discharge is happened from the anode of the CRT, for those through high voltage discharge gaps H1, H2 to flow the discharge energy to the ground in order to protect the circuit elements in the circuit board, the focus contact structure shown in FIG. 5 is used. That is, when the second focus pin 22*b* generates abnormal discharge, this abnormal discharge will flow through the high voltage discharge gap H between the electrode A pressed connected to the second focus contact 70*b* of the second focus pin and the grounded electrode B to the ground.

When an abnormal discharge is generated in the first focus pin 22*a*, the abnormal discharge will flow through the low voltage discharge gap L1 between the first focus contact 70*a* and the electrode A connected to the second focus contact 70*b* to the electrode A, and flows through the high voltage discharge gap H between the electrodes A and B, so as to protect the circuit elements on the circuit board.

Therefore, the first focus contact may use the electrode A through the low voltage discharge gap L1, the numbers of elements are reduced, and thus the CRT socket can be miniaturized.

The focus contact may directly connect to the electrode A. By providing the low voltage discharge gap L1 between the other focus contacts and the electrode A, the voltage difference or the dynamic voltage variation between the focus pins can be absorbed to some degree, and the electrode A is used commonly.

However, in comparison with independently providing high voltage discharge gap so as to make grounded electrode b opposite to the electrode a as shown in FIG. 6, it is inevitable to narrow the withstanding voltage difference between focus pins. Because the electric connect situation and the discharge wiring of focus pins are different from each other, the discharge voltage of every focus pins just before discharge still need to be improved to be the same.

SUMMARY OF THE INVENTION

In view of the above, the Japanese patent application 2001-285531 filed by the applicant shall be further improved. The invention aims at this and provides an effectively miniaturized CRT socket capable of assuring large withstanding discharge voltage difference between the focus pins of the CRT socket, unifying the voltage just before discharge, and simplifying the structure of the high voltage discharge gap.

The invention relates to a CRT (cathode ray tube) socket to which a plurality of focus means of the CRT are connected, characterized in comprising electrodes (FA) each positioned on each focus contact of a plurality of focus pins connected to the CRT respectively; a common electrode (A) which is separated from the electrodes (FA) with a low voltage discharge gap (L); and a grounded electrode (B) which is opposite to the common electrode (A) with a high voltage discharge gap (H).

By making the independent discharge line of a plurality of focus pins the same with each other, all discharge voltages just before discharge are the same. Further, by constructing a plurality of low voltage discharge gaps between the focus contacts for connecting with the focus pins, the withstanding discharge voltage difference can be enlarged.

DETAILED DESCRIPTION OF THE PREFERRED EMBODIMENTS

Figure 1:
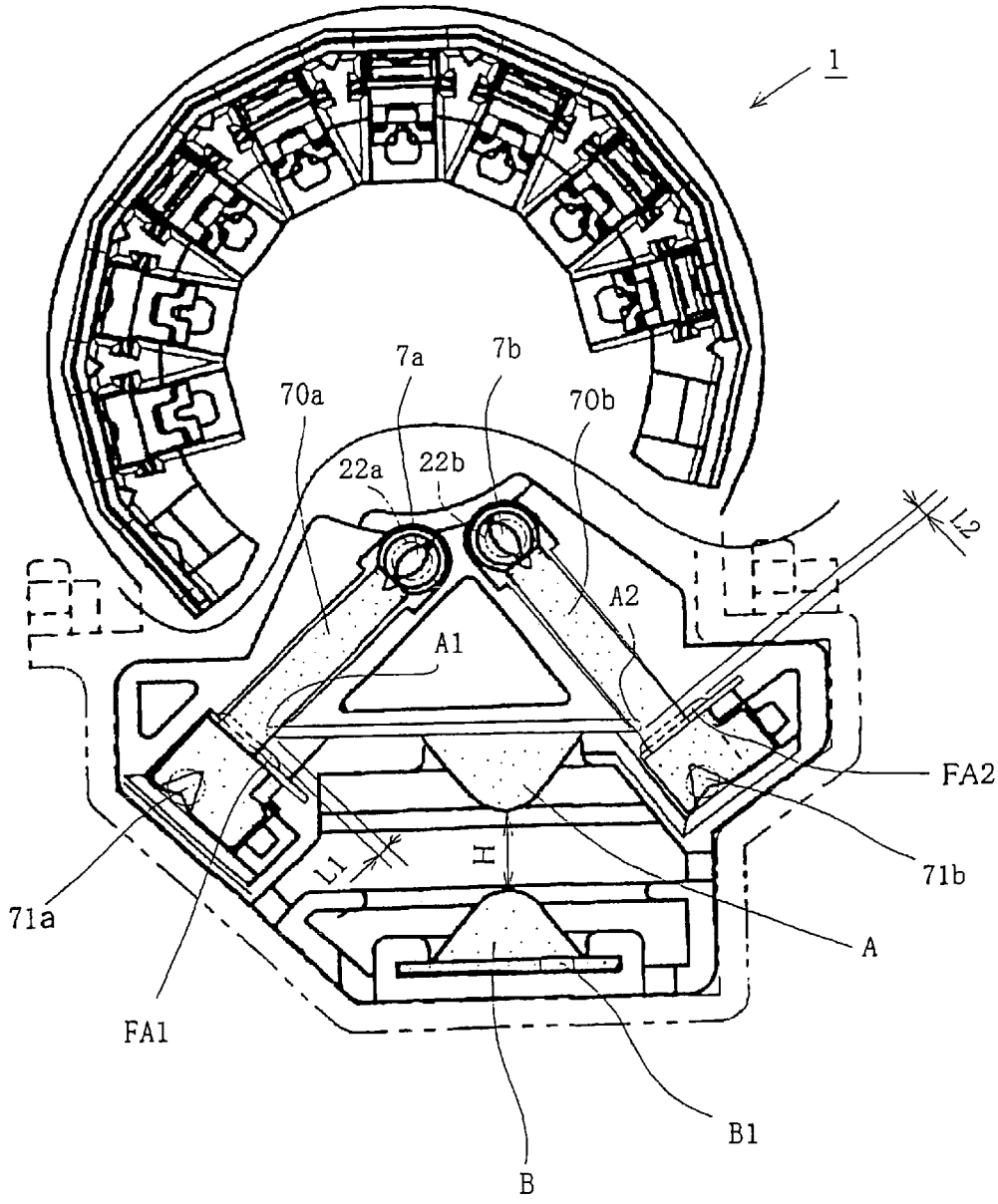
FIG. 1 shows the main structure of the CRT socket 1 of the invention.
Figure 2:
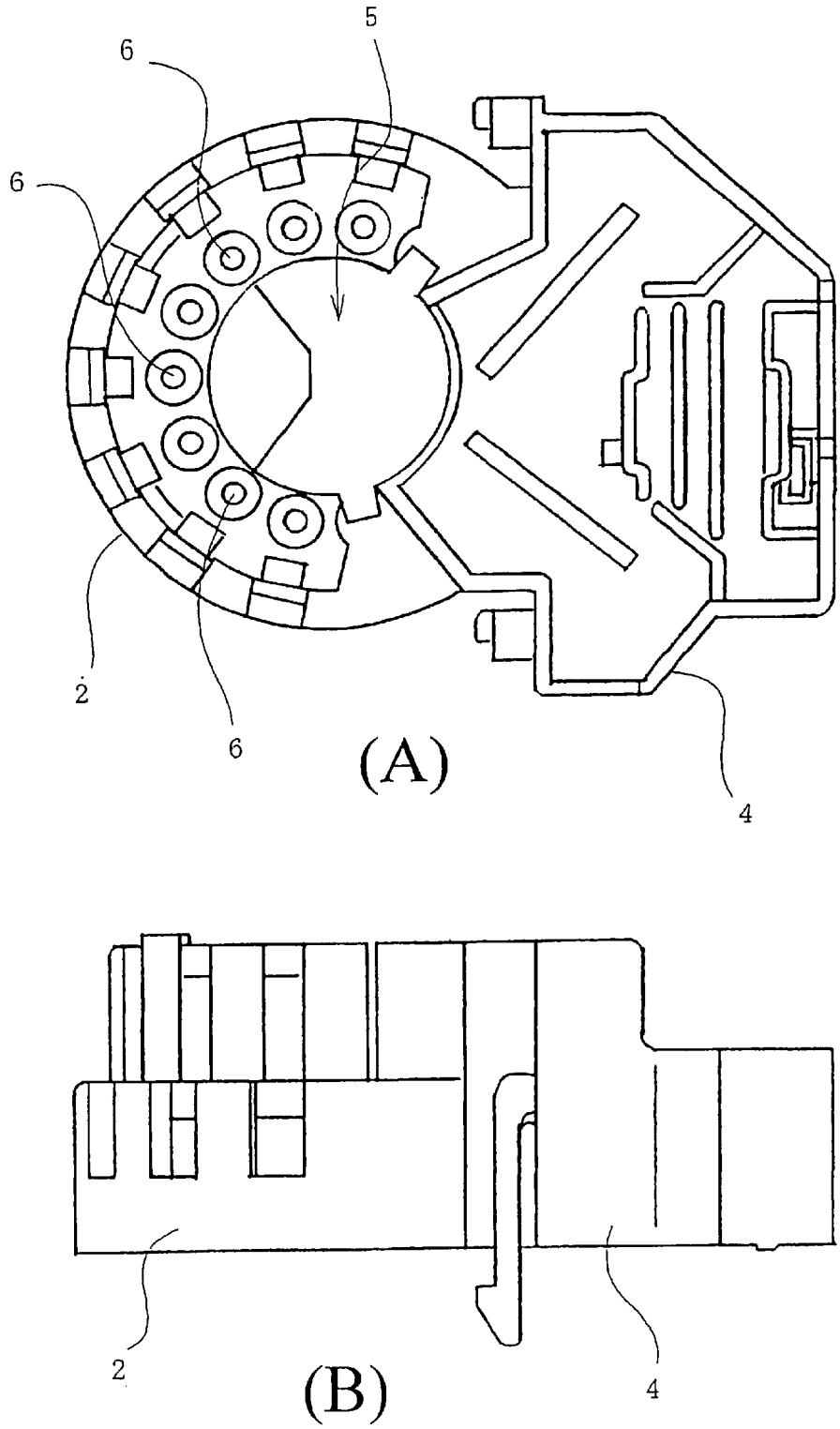
FIGS. 2(A) and 2(B) are the plane view and side view of the housing of the CRT socket 1 of the invention respectively.

The embodiment of the invention will be explained hereinafter by using a dual-focus tube as an example. FIG. 1 is a main structure of the CRT socket 1 of the invention, and FIG. 2 shows a housing where an annular portion 2 and a base portion 3 are integrally formed with resin. FIG. 2(A) is a plane view, while FIG. 2(B) is a side view. A cylindrical center opening 5 is provided in the center of the annular portion 2 for inserting the electron gun of CRT.

Figure 3:
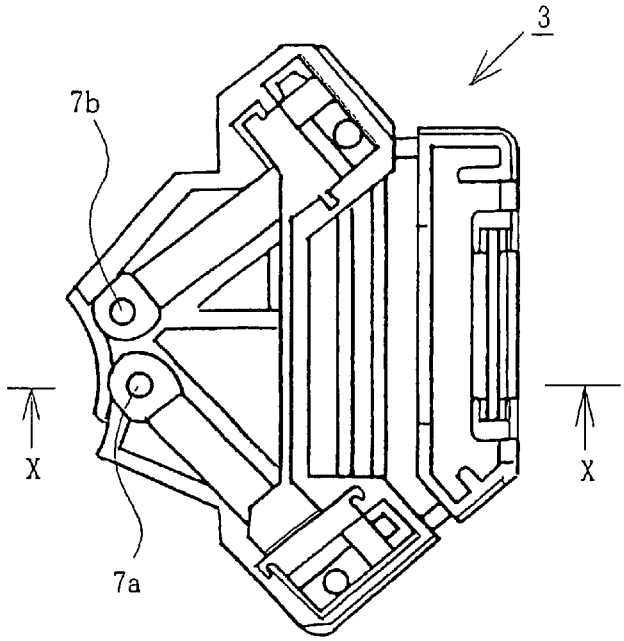
FIGS. 3(A) and 3(B) are the plane view and side view of the outer case of the CRT socket 1 of the invention respectively.
Figure 3:
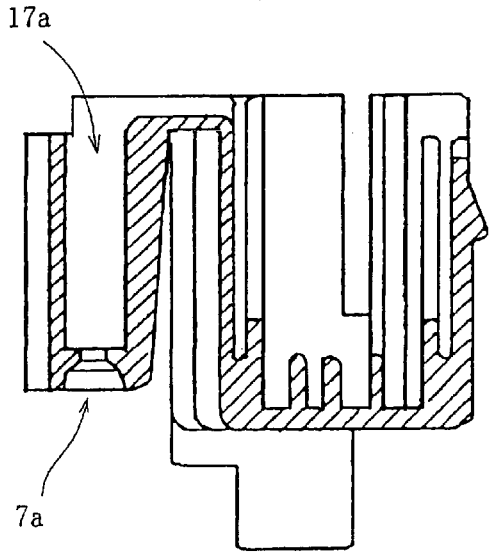

FIG. 3 shows an outer case 3, where FIG. 3(A) is a plane view, while FIG. 3(B) is a sectional view cutting along the X—X line shown in FIG. 3(A).

Figure 4:
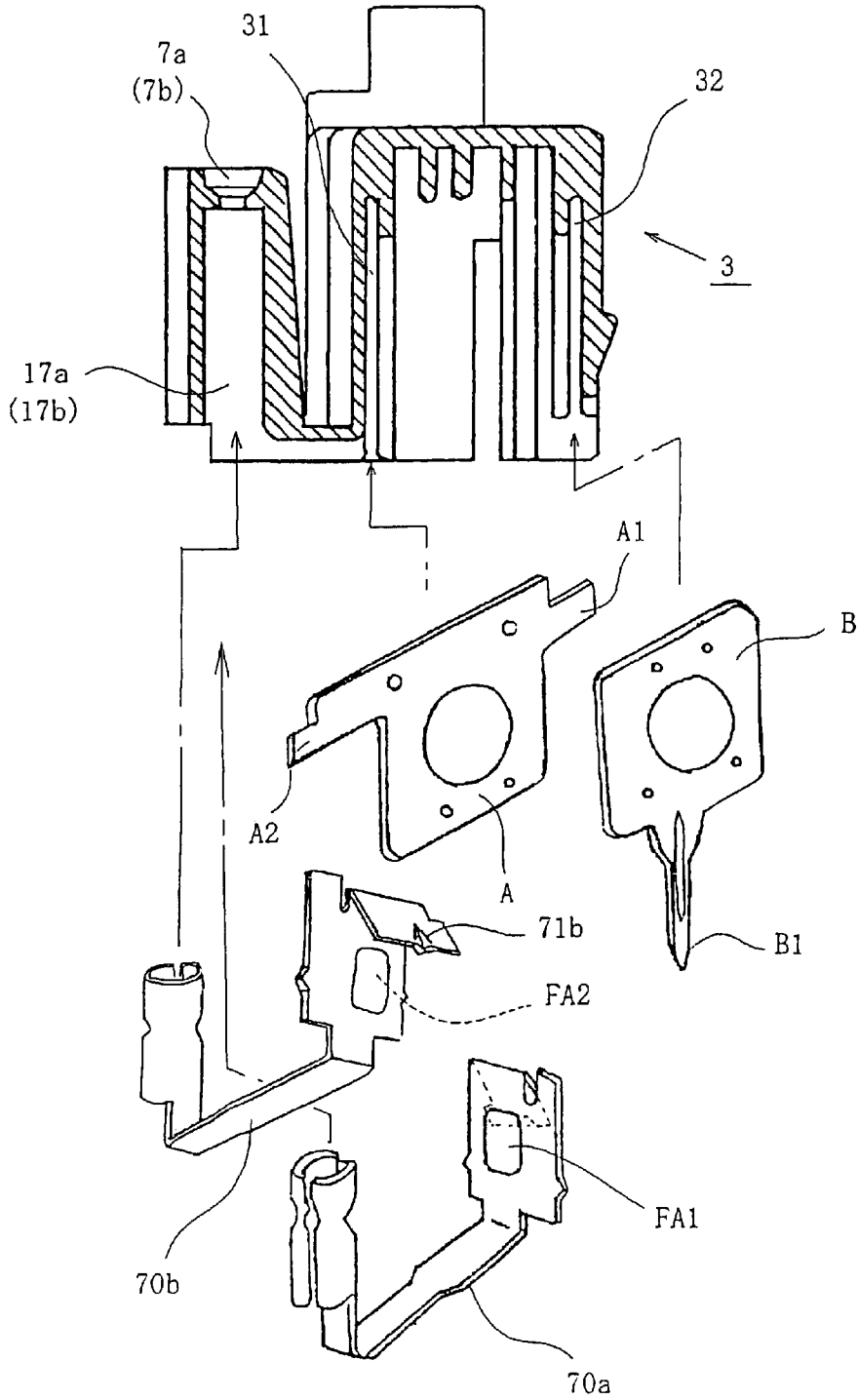
FIG. 4 is an exploded view of the outer case of the CRT socket 1 of the invention, which shows the parts of the outer case.

As shown in FIG. 4, in the outer case 3, an accommodating room 31 for an electrode A is provided for inserting a common electrode A, a first focus contact accommodating room 17*a* and a second focus contact accommodating room 17*b* are formed in "八" shaped for housing a first focus contact 70*a* and a second focus contact 70*b* respectively, and an accommodating room 32 for an electrode B is provided for inserting the electrode B. The outer case 3 is inserted into the base portion 4 as shown in FIG. 2 so as to form a CRT socket 1.

The following explanation will refer to FIG. 1 in which the main structure of the CRT socket 1 is shown viewing from the inner side of the outer case, and FIG. 4 in which the connection relationship of the focus portion may be understood from the exploded view.

In order to connect to the first focus pin 22*a* on one side of the CRT, a first focus contact 70*a* is provided where one of its ends is opposite to one of the focus contact openings 7*a* in the CRT socket 1, and the other end is provided with a wiring contact 71*a*.

For connecting to a second focus pin 22*b* on the other side of CRT, a second focus contact 70*b* is provided where one of its ends is opposite to the other focus contact opening 7*b* in the CRT socket 1. The other end of the second focus contact 70*b* has a wiring connect portion 71*b*.

Low voltage discharge electrodes FA1, FA2 are provided on the first focus contact 70*a* and the second focus contact 70*b* respectively.

The common electrode A is arranged as having low voltage discharge electrodes A1, A2, where the low voltage discharge electrode A1 is opposite to the low voltage discharge electrode FA1 of the first focus contact with a low voltage discharge gap L1 intervened therebetween, and the low voltage discharge electrode A2 is opposite to the low voltage discharge electrode FA2 of the second focus contact with a low voltage discharge gap L2 intervened therebetween.

On the opposite side of the common electrode A, a grounded electrode B is provided, where a high voltage discharge gap H is intervened between electrodes A and B.

On the grounded electrode B, a grounded terminal B1 is provided for conducting an abnormal discharge current to ground.

In FIGS. 1 and 4, while the configurations of the focus contacts on left and right sides are the same so as to obtain uniformization of elements, the same effect can be obtained if the configurations of the focus contacts on left and right sides are symmetric.

The structure of the annular portion is the same as that show in known CRT socket, and thus an explanation thereto is omitted.

In the embodiment of the invention, while it is explained with a dual-focus tube as an example, the other multiple focus tube, such as tri-focus tube, can also be implemented by providing a common electrode A opposite to a low voltage discharge electrode FA in the focus contact, providing a grounded electrode B facing the common electrode A, and providing low voltage discharge gaps L between the common electrode A and the low voltage discharge electrode FA of each focus contacts respectively.

Effect of the Invention

By using the structure of the focus portion of the invention, the abnormal transverse current generated by the focus pins of the CRT may flow through substantially the same route to discharge to ground, so that the discharge voltages just before discharge in all the focus pins are substantially the same.

Figure 5:
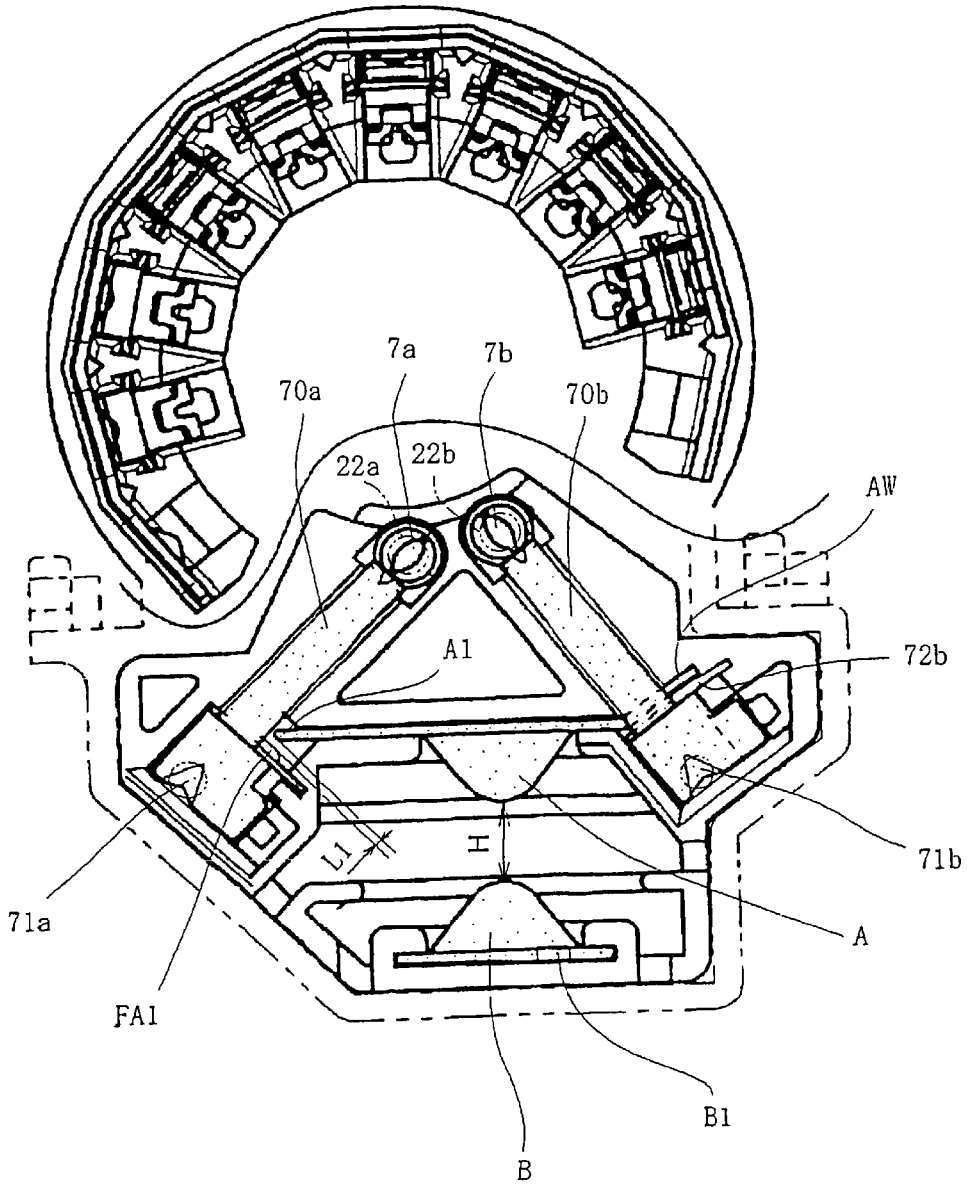
FIG. 5 shows the focus portion of the CRT socket of a prior art.
Figure 6:
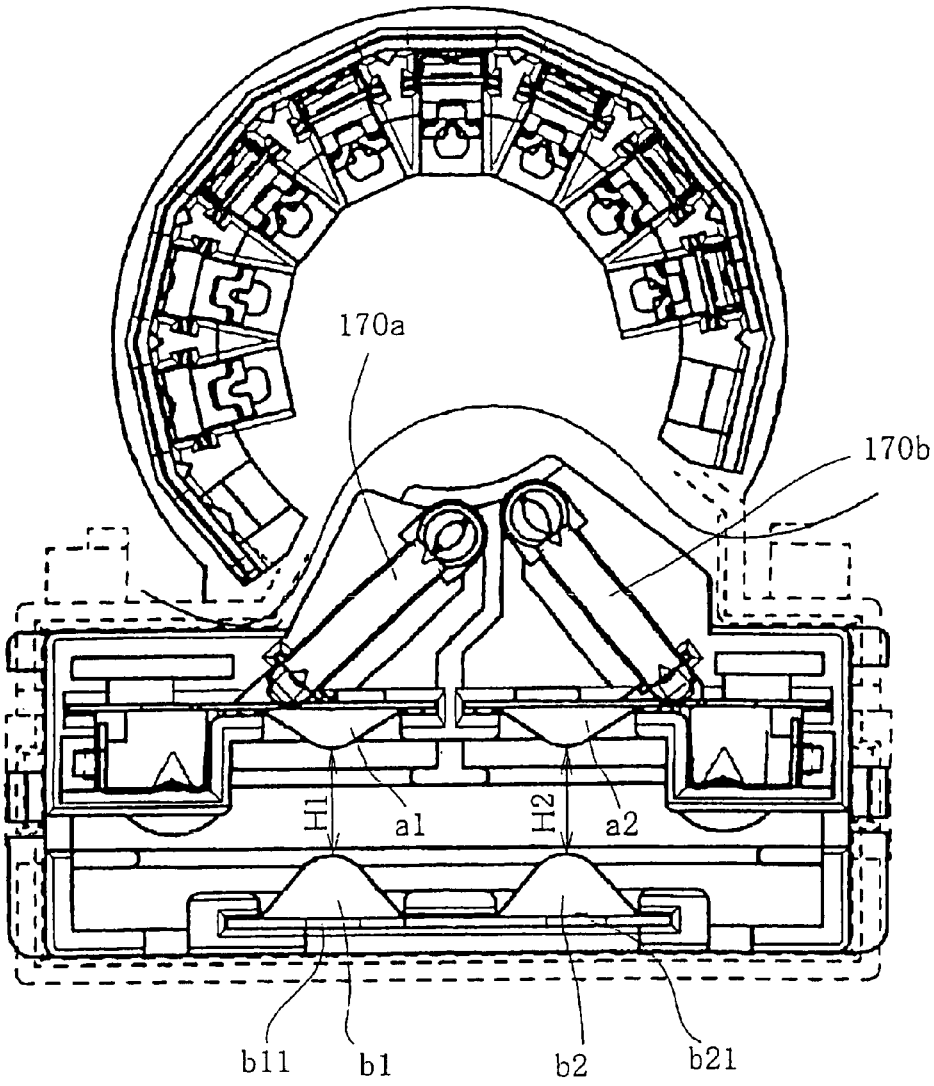
FIG. 6 shows the main structure of the CRT socket 100 of the prior art, using the focus portion as center and viewing from inside of the outer case.
Figure 7:
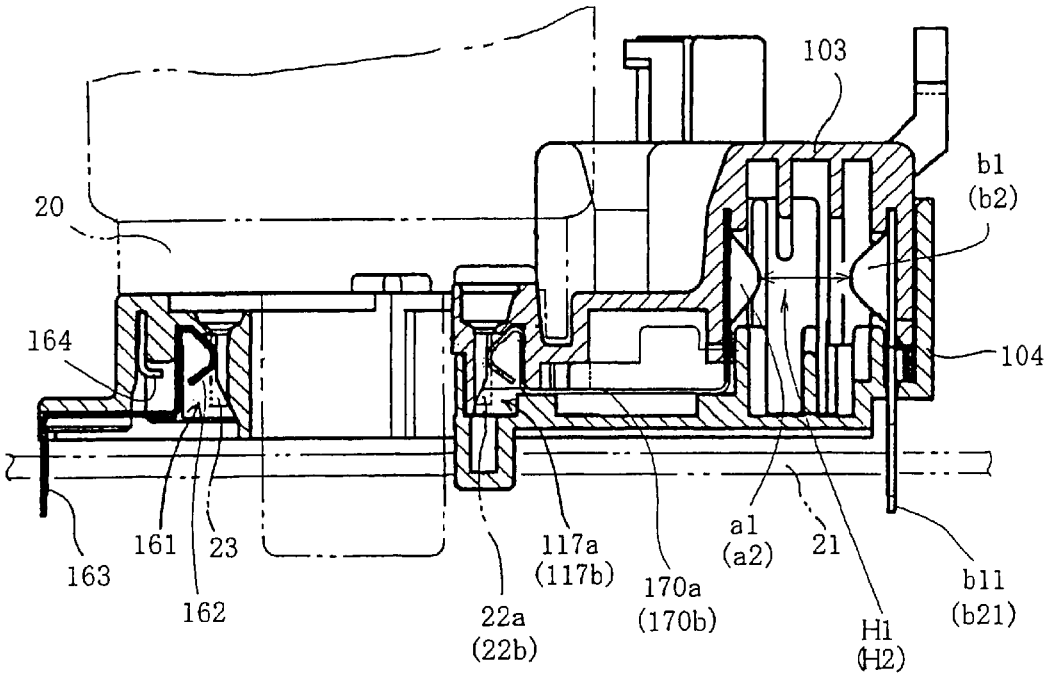
FIG. 7 is a sectional view of the main portion of the CRT socket 100 of the prior art.
Figure 8:
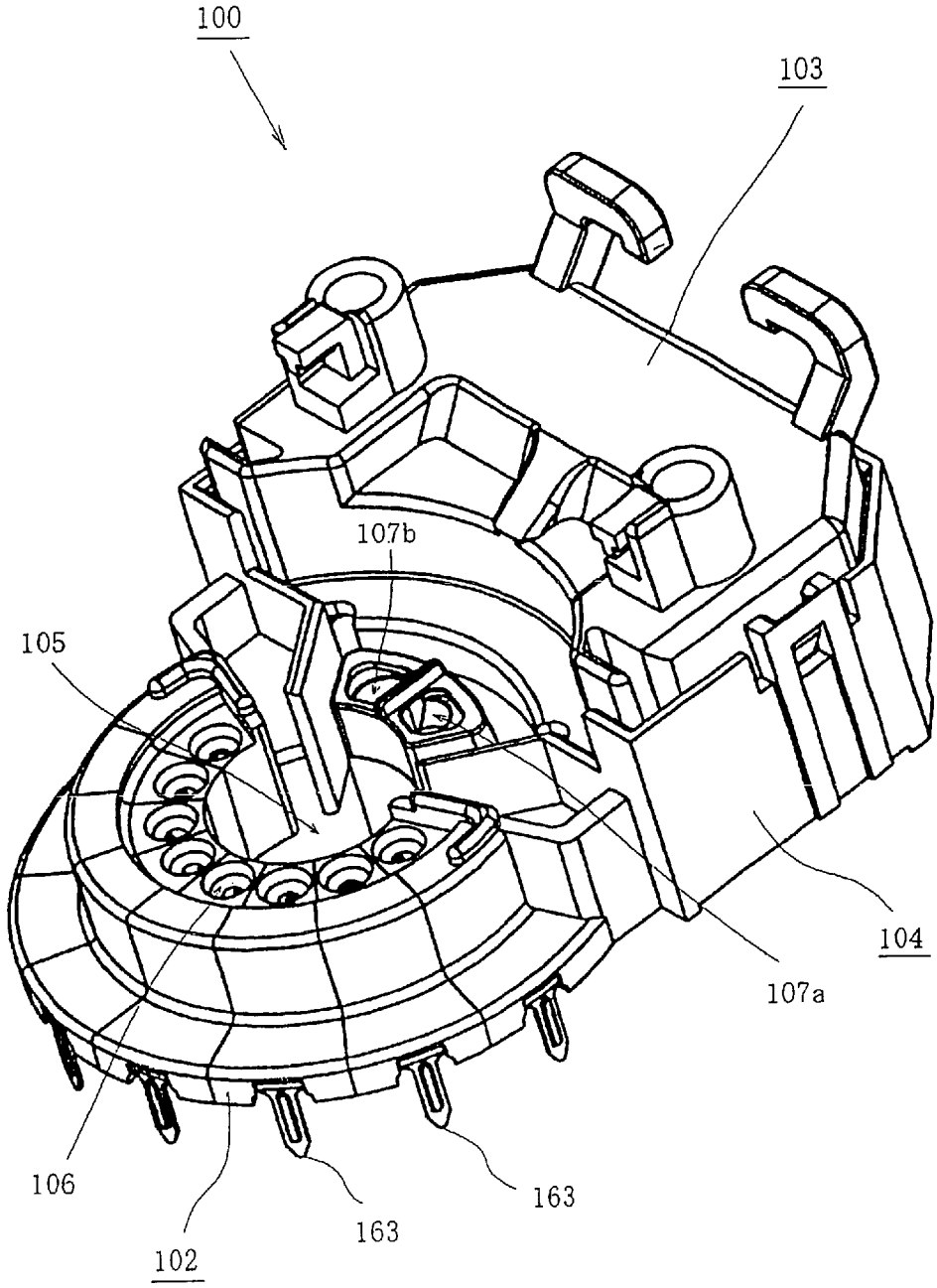
FIG. 8 is a perspective view of the CRT socket 100 of the prior art.

Using a dual-focus pin as an example, because a low voltage discharge gap L is provided between the common electrode A and each focus contact, the first focus pin 22*a* and the second focus pin 22*b* have low voltage discharge gaps L1 and L2 respectively. In comparison with the structure shown in FIG. 5, the first and second focus pins have the same abnormal current discharge characteristic, and thus, in comparison with the prior art shown in FIG. 5, two times of withstanding discharge voltage characteristic can be obtained between the focus pins.

What is claimed is:

1. A CRT (cathode ray tube) socket to which a plurality of focus means of the CRT are connected, characterized in comprising:

electrodes (FA) each positioned on each focus contact of a plurality of focus pins connected to the CRT respectively;

a common electrode (A) which is separated from the electrodes (FA) with a low voltage discharge gap (L); and a grounded electrode (B) which is opposite to the common electrode (A) with a high voltage discharge gap (H).

* * * * *